US006824081B2

(12) United States Patent
Peters et al.

(10) Patent No.: US 6,824,081 B2
(45) Date of Patent: Nov. 30, 2004

(54) NEEDLE CONTROLLED FUEL INJECTOR WITH TWO CONTROL VALVES

(75) Inventors: Lester L. Peters, Columbus, IN (US); C. Edward Morris, Columbus, IN (US); David M. Rix, Columbus, IN (US); Shankar C. Venkataraman, Columbus, IN (US)

(73) Assignee: Cummins Inc., Columbus, IN (US)

( * ) Notice: Subject to any disclaimer, the term of this patent is extended or adjusted under 35 U.S.C. 154(b) by 201 days.

(21) Appl. No.: 10/183,566

(22) Filed: Jun. 28, 2002

(65) Prior Publication Data

US 2004/0000600 A1 Jan. 1, 2004

(51) Int. Cl.[7] ..... F02M 59/00; F02M 39/00; B05B 1/30

(52) U.S. Cl. ..... 239/533.2; 239/533.3; 239/533.8; 239/88; 239/585.1; 239/585.5

(58) Field of Search ..... 239/533.2, 533.3, 239/533.7, 533.9, 585.1–585.2, 88–93, 533.8; 251/129.15, 129.21, 127

(56) References Cited

U.S. PATENT DOCUMENTS 4,450,783 A 5/1984 Morris et al.
4,840,155 A 6/1989 Karle
5,664,545 A 9/1997 Kato et al.
5,671,715 A 9/1997 Tsuzuki
5,758,618 A 6/1998 Jay et al.
5,779,149 A * 7/1998 Hayes, Jr. ..... 239/124
5,819,704 A 10/1998 Tarr et al.
5,862,793 A 1/1999 Jay et al.
5,893,516 A * 4/1999 Harcombe et al. ..... 239/95
5,941,215 A 8/1999 Augustin
5,950,600 A 9/1999 Ricco
6,029,632 A 2/2000 Augustin
6,056,264 A 5/2000 Benson et al.
6,340,121 B1 * 1/2002 Lambert ..... 239/533.4

* cited by examiner

*Primary Examiner*—Davis Hwu
(74) *Attorney, Agent, or Firm*—Nixon Peabody LLP; Tim L. Brackett, Jr.; J. Bruce Schelkopf

(57) ABSTRACT

An improved fuel injector is provided which effectively controls fuel injection events using two injection control valves which operate in series to control the movement of a nozzle valve element. An outer injection control valve and actuator assembly operates to control fluid pressure in a control volume adjacent an inner injection control valve thereby controlling the movement of the inner control valve which, in turn, controls fuel pressure in an inner control volume adjacent one end of the nozzle valve element. A particular design of the inner injection control valve prevents control valve oscillations thereby minimizing unwanted fuel injection variations.

18 Claims, 5 Drawing Sheets

NEEDLE CONTROLLED FUEL INJECTOR WITH TWO CONTROL VALVES

TECHNICAL FIELD

The invention relates to an improved fuel injector which effectively controls fuel metering.

BACKGROUND OF THE INVENTION

In most fuel supply systems applicable to internal combustion engines, fuel injectors are used to direct fuel pulses into the engine combustion chamber. A commonly used injector is a closed-nozzle injector which includes a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block fuel flow through the nozzle orifices. In many fuel systems, when the pressure of the fuel within the nozzle cavity exceeds the biasing force of the nozzle spring, the nozzle valve element moves outwardly to allow fuel to pass through the nozzle orifices, thus marking the beginning of injection.

In another type of system, such as disclosed in U.S. Pat. No. 5,819,704, the beginning of injection is controlled by a servo-controlled needle valve element. The assembly includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve.

U.S. Pat. No. 5,862,793 discloses an injection valve arrangement which includes a solenoid actuated control valve for controlling drain flow from a chamber, a poppet type needle valve movable outwardly to permit injection and an auxiliary valve positioned between the chamber and the needle valve for controlling high pressure fuel flow to a needle control chamber positioned adjacent an outer end of the needle valve. The opening of the control valve causes the opening of the auxiliary valve which then causes the opening of the needle valve. However, the auxiliary valve opens to allow high pressure fuel to enter the needle control chamber thereby increasing the pressure in the needle control chamber. The high pressure in the needle control chamber acts on the needle valve to move the needle valve outwardly into an open position to cause injection.

There is still a need for a simple, improved fuel injector which is capable of effectively controlling fuel metering while handling high fuel injection flow rates using conventional actuators.

SUMMARY OF THE INVENTION

It is, therefore, one object of the present invention to overcome the deficiencies of the prior art and to provide a fuel injector which better enables large engines to meet future diesel engine exhaust emission requirements while minimizing fuel consumption.

Another object of the present invention is to provide a fuel injector which can be effectively used in high horsepower engines in combination with actuator assemblies used on smaller engines/injectors.

Yet another object of the present invention is to provide a fuel injector for larger engines which avoids larger and higher energy consuming actuators and thus minimizes injector packaging and costs.

Still another object of the present invention is to provide a fuel injector having a primary control valve and an intermediate control valve wherein oscillations of the intermediate valve are minimized.

These and other objects are achieved by providing a fuel injector for injecting fuel at high pressure into the combustion chamber of an engine, comprising an injector body containing an injector cavity and an injector orifice communicating with one end of the injector cavity to discharge fuel into the combustion chamber. The injector also includes a nozzle valve element positioned in one end of the injector cavity adjacent the injector orifice and movable between an open position in which fuel may flow through the injector orifice into the combustion chamber and a closed position in which fuel flow through the injector orifice is blocked. The injector also includes a first control volume positioned to receive a pressurized supply of fuel, a drain circuit for draining fuel from the first control volume to a low pressure drain and a first valve seat positioned along the drain circuit. A first injection control valve is also positioned along the drain circuit to control fuel flow from the first control volume and includes a reciprocally mounted control valve member movable between an open position permitting flow through the drain circuit and a closed position in sealing abutment against the first valve seat to block flow through the drain circuit. A second control volume is also provided and positioned adjacent an outer end of the nozzle valve element to receive a pressurized supply of fuel while the drain circuit is positioned to drain fuel from the second control volume to the low pressure drain. A second valve seat is positioned along the drain circuit along with a second injection control valve to control fuel flow from the second control volume. The second injection control valve includes a reciprocally mounted control valve member movable between an open position permitting flow through the drain circuit to cause a decrease in fuel pressure in the second control volume and movement of the nozzle valve element into the open position, and a closed position in sealing abutment against the second valve seat to block flow through the drain circuit to cause an increase in fuel pressure in the second control volume and movement of the nozzle valve element into the closed position. Movement of the first injection control valve into the open position causes a decrease in fuel pressure in the first control volume thereby causing movement of the second injection control valve into the open position.

The first injection control valve may include a solenoid actuator assembly while the second injection control valve is spring biased into the closed position. A high pressure chamber may be positioned around the second injection control valve axially between the first injection control valve and the second control volume. The second injection control valve includes a large diameter portion positioned axially between the first control volume and the high pressure chamber, and a small diameter portion having an outer diameter smaller than the large diameter portion and positioned axially between the high pressure chamber and the second control volume. The second injection control valve includes a bias spring positioned in the high pressure chamber for biasing the second injection control valve into the closed position. The nozzle valve element may include an outer diameter greater than the largest outer diameter of the second injection control valve member. The nozzle valve element moves toward the second injection control valve into the open position. A bias spring for biasing the nozzle valve element into the closed position may be provided. A spring chamber containing the nozzle valve bias spring may be provided along with a high pressure fuel supply circuit including at least a portion of the spring chamber. A high pressure fuel supply circuit may also include at least a portion of the high pressure chamber.

DETAILED DESCRIPTION OF THE INVENTION

Figure 1:
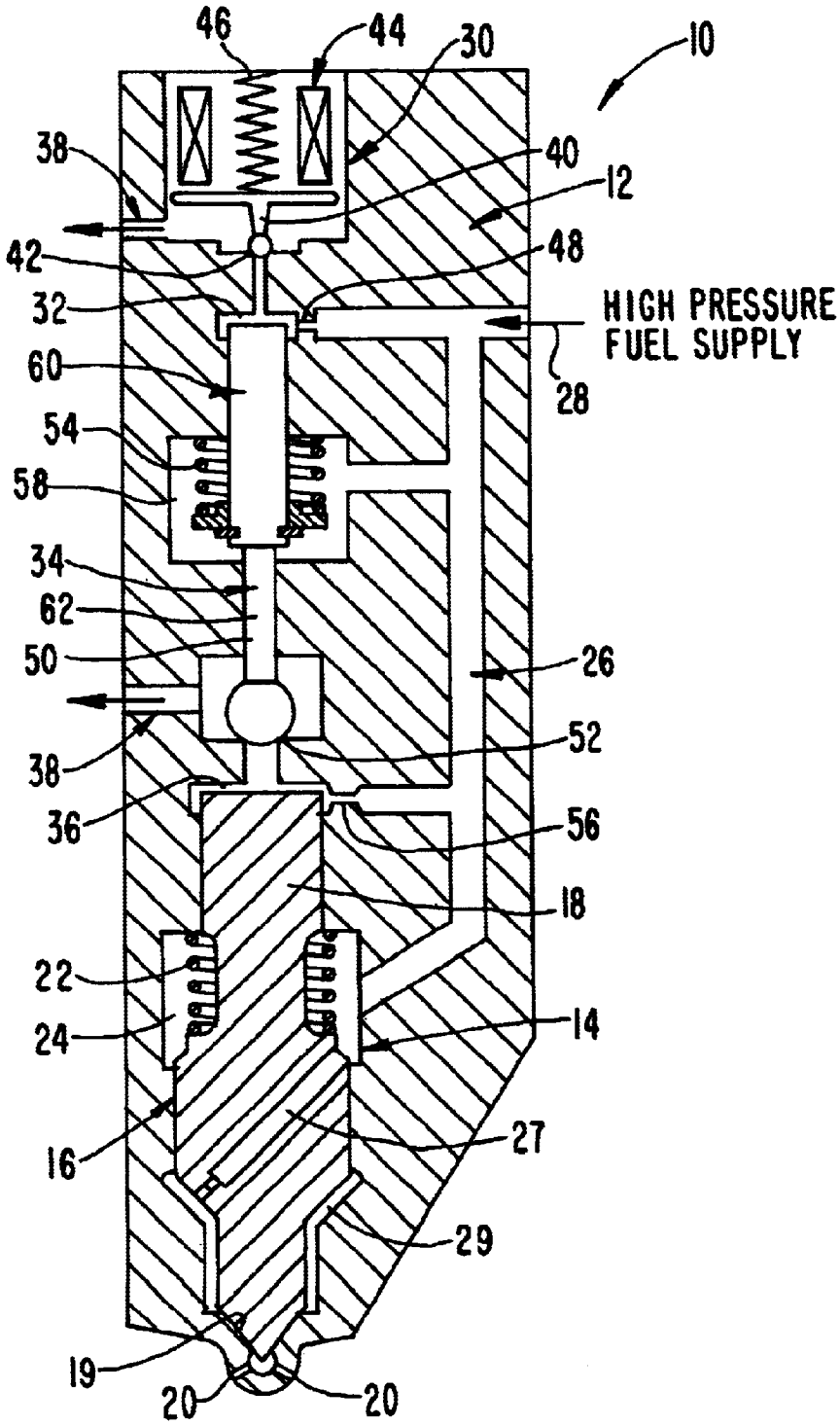
FIG. 1 is a cross sectional schematic view of the fuel injector of the present invention.

Referring to FIG. 1, there is shown a closed nozzle fuel injector of the present invention, indicated generally at 10, which functions to effectively permit accurate and reliable control of fuel metering during fuel injection into the combustion chamber of an internal combustion engine. Fuel injector 10 is especially advantageous in larger, high horsepower engines requiring greater fuel injection flow rates while avoiding the need for larger injection control valve and actuator assemblies and thus avoiding increased energy consumption and increased injector packaging dimensions.

Fuel injector 10 generally includes an injector body 12 forming an injector cavity 14. The lower portion of fuel injector body 12 includes a closed nozzle assembly, indicated generally at 16, which includes a nozzle valve element 18 reciprocally mounted for opening and closing injector orifices 20 formed in body 12 thereby controlling the flow of injection fuel into an engine combustion chamber (not shown). A bias spring 22 is positioned in a spring chamber 24, formed in injector cavity 14, for abutment against a land formed on nozzle valve element 18 so as to bias nozzle valve element 18 into a closed position as shown in FIG. 1.

A high pressure fuel supply circuit 26 is formed in injector body 12 for supplying high pressure fuel from a high pressure source, such as high pressure common rail 28, to injector cavity 14. Fuel injector 10 of the present invention may be adapted for use with a variety of fuel systems and high pressure fuel sources. For example, fuel injector 10 may receive high pressure fuel from high pressure common rail 28 or, alternatively, a pump-line-nozzle system or be modified to form a unit injector incorporating, for example, a mechanically actuated plunger into the injector body. Thus, fuel injector 10 of the present invention may be incorporated into any fuel system which supplies high pressure fuel to the injector while permitting the injector to control the timing and quantity of the fuel injected into the combustion chamber.

The fuel injector 10 of the present invention further includes a first or outer injection control valve 30 positioned for controlling fuel flow from a first or outer control volume 32, and a second or inner injection control valve 34 for controlling fuel flow from a second or inner control volume 36. High pressure fuel circuit 26 delivers high pressure fuel to first and second control volumes 32, 36 while a drain circuit 38 directs fuel from first control volume 32 and second control volume 36 to a low pressure drain. An outer end of inner injection control valve 34 is positioned within first control volume 32 and exposed to fuel residing in volume 32. Outer injection control valve 30 is positioned along drain circuit 38 to control fuel flow through drain circuit 38 so as to control the fuel pressure in first control volume 32. Specifically, outer injection control valve 30 includes a reciprocally mounted control valve member 40 for engaging a first or outer valve seat 42 in a closed position in sealing abutment against first valve seat 42 to block flow through drain circuit 38 thereby permitting an increase in fuel pressure in first control volume 32. Control valve member 40 is also movable, by for example, the energization of an actuator assembly 44, into an open position against the bias force of a bias spring 46 to permit fuel flow through the drain circuit. A supply orifice 48 is positioned in a portion of high pressure fuel supply circuit 26 feeding first control volume 32 and designed with a smaller cross sectional flow area than drain circuit 38 and thus a greater amount of fuel is drained from first control volume 32 than is replenished via supply orifice 48. As a result, the pressure in first control volume 32 decreases upon opening of control valve member 40. Actuator assembly 44 may be any type of actuator assembly capable of selectively controlling the movement of control valve member 40. For example, a fast proportional actuator, such as an electromagnetic, magnetostrictive or piezoelectric type, could be used to move control valve member 40.

Inner injection control valve 34 includes a reciprocally mounted control valve member 50 having an outer end positioned in first control volume 32 and an inner end positioned for sealing abutment against a second valve seat 52 when in a closed position. Second valve seat 52 is formed along drain circuit 38 so that positioning of control valve member 50 in the closed position blocks the drain flow of fuel from inner control volume 36 causing the pressure in control volume 36 to increase. A bias spring 54 is positioned to bias control valve member 50 into the closed position against second valve seat 52. Control valve member 50 is also movable into an open position to allow fuel to drain from second control volume 36 through drain circuit 38 thereby decreasing the pressure in second control volume 36 due to a supply orifice 56 which functions in a similar manner to supply orifice 48. Bias spring 54 is positioned in a high pressure chamber 58 positioned around inner injection control valve 34 and axially between outer injection control valve 30 and inner control volume 36. High pressure chamber 58 receives high pressure fuel from high pressure fuel supply circuit 26 as shown in FIG. 1. The outer section of inner injection control valve 34 includes a large diameter portion 60 sized to form a close sliding fit with the opposing surface of injector body 12 thereby forming a partial fluid seal between high pressure chamber 58 and outer control volume 32. Inner injection control valve 34 also includes a small diameter portion 62 having an outer diameter smaller than large diameter portion 60 and positioned axially between high pressure chamber 58 and inner control volume 36. Likewise, small diameter portion 62 is sized to form a close sliding fit with the opposing bore surface of injector body 12 thereby creating a partial fluid seal separating inner control volume 36/drain circuit 38 from high pressure chamber 58. The significance of large diameter portion 60 and small diameter portion 62 on the operation of inner control valve 34 will be discussed hereinbelow.

During operation, prior to an injection event, actuator assembly 44 of outer injection control valve 30 is de-energized causing control valve member 40 to be positioned in sealed abutment against outer valve seat 42 by the bias force of spring 46. As a result, the fuel pressure level in outer control volume 32 is substantially the same as the fuel pressure level in fuel supply circuit 26. Thus, high fuel pressure forces are imparted on the outer end of large diameter portion 60 of inner injection control valve 34 by the fuel in outer control volume 32 which, in combination with the bias force of spring 54 maintain inner control valve 34 in its closed position. Thus, the total closing forces acting on inner injection control valve 34, including fuel pressure forces acting on the outer end of valve 34 in outer control volume 32 and the bias force of bias spring 54, are greater than the fuel pressure forces tending to open inner control valve 34. As a result, as shown in FIG. 1, control valve member 50 of inner control valve 34 is maintained in the closed position against inner valve seat 52 thereby blocking flow through drain circuit 38. Thus, the fuel pressure level in inner control volume 36 is also at the pressure level of the fuel supply circuit 26. The high pressure forces acting on the outer end of needle valve element 18, in combination with the closing bias force of spring 22, maintain needle valve element 18 in its closed position blocking flow through injector orifices 20. High pressure fuel supply circuit 26 may include a supply passage 27 formed in needle valve element 18 for delivering high pressure fuel from spring chamber 24 to a lower nozzle cavity 29 for further delivery to the combustion chamber via orifices 20 when needle valve element 18 moves from the closed to the open position. At a predetermined time during the supply of high pressure fuel to high pressure fuel supply circuit 26, actuator assembly 44 of outer injection control valve 30 is energized to controllably move control valve member 40 from the position shown in FIG. 1 outwardly to an open position permitting fuel flow from outer control volume 32 through drain circuit 38 to a low pressure drain. Simultaneously, high pressure fuel flows from high pressure fuel supply circuit 26 through supply orifice 48 into outer control volume 32. However, orifice 48 is designed with a smaller cross sectional flow area than the portion of drain circuit 38 upstream of outer valve seat 42 and thus a greater amount of fuel is drained from outer control volume 30 than is replenished via supply orifice 48. As a result, the pressure in outer control volume 30 immediately decreases. Upon a sufficient decrease in the fuel pressure forces acting on the outer end of control valve member 40 in outer control volume 32, the fuel pressure forces tending to open inner injection control valve member 34 become larger than the fuel pressure forces acting on control valve member 50 in outer control volume 32 in combination with the bias force of spring 54 to thereby move control valve member 50 outwardly from the closed position into an open position. Specifically, by designing small diameter portion 62 with a smaller diameter than large diameter portion 60 of control valve member 50, and including high pressure chamber 58 having a pressure level equal to the pressure level in fuel supply circuit 26, the point at which control valve member begins to open during the decrease of fuel pressure in inner control volume 32 can be controlled while also ensuring that control valve member 50 is maintained in the open positioned in a controllable manner without oscillations while in the open position. A difference in diameter between small diameter portion 62 and large diameter portion 60 creates greater opening forces on control valve member 50 thereby avoiding the undesirable oscillations. As the outer end of control valve member 50 approaches the outer face of outer control volume 32 and tends to block the flow from drain circuit 38, the fuel pressure in outer control volume 32 tends to increase. In prior conventional control designs, this tendency causes control valve member 50 to move back toward the closed position thereby initiating cyclical pressure variations in the outer control volume once again. The cyclical pressure variations result in an oscillating movement of prior conventional control valve members toward open and closed positions which interferes with fuel injection controllability. The design of the present invention avoids this oscillating effect thereby improving the controllability of the fuel injection event.

Upon the opening of inner injection control valve 34, high pressure fuel flows from inner control volume 36 through drain circuit 38. Simultaneously, high pressure fuel flows from high pressure fuel supply circuit 26 through orifice 56 into inner control volume 36. However, orifice 56 is designed with a smaller cross sectional flow area than drain circuit 38 upstream of second valve seat 52 and thus a greater amount of fuel is drained from inner control volume 36 than is replenished via orifice 56. As a result, the pressure in inner control volume 36 immediately decreases. Fuel pressure forces acting on needle valve element 18 due to high pressure fuel in lower nozzle cavity 29 begins to move needle valve element 18 outwardly from the closed position shown in FIG. 1 toward an open position. Thus, the difference in diameters between large diameter portion 60 and small diameter portion 62 and the use of high pressure chamber 58 containing high pressure fuel for acting on the surfaces creating the forces tending to move control valve member outwardly, enables control valve member 50 to reach an equilibrium position permitting a small amount of drain flow from outer control volume 32 to compensate for the charge flow entering control volume 32 so as to automatically maintain control valve member 50 in its open position without oscillations.

Fuel injector 10 of the present invention is especially advantageous in high horsepower engines requiring a larger amount of fuel for injection during each injection event. Nozzle valve element 18 of fuel injector 10, when applied to a high horsepower engine, includes greater needle lift, increased injector orifice size and a larger nozzle valve element seat diameter to meet the larger fuel injection demand. As a result, the nozzle valve element is designed with a larger outer diameter than conventional nozzle valve elements resulting in a larger inner control volume 36. In conventional injectors used in high horsepower engines which do not include an inner injection control valve, a larger and more powerful actuator assembly is required to control the flow from the larger control volume adjacent the nozzle valve element thereby resulting in increased component costs, energy consumption and packaging difficulties. Fuel injector 10 of the present invention avoids the use of a larger actuator assembly and permits conventional smaller less energy consuming actuator assemblies typically used on medium horsepower engines to be used on high horsepower engines while effectively controlling the movement of the nozzle valve element thereby providing accurate and reliable control over fuel injection events.

Figure 2:
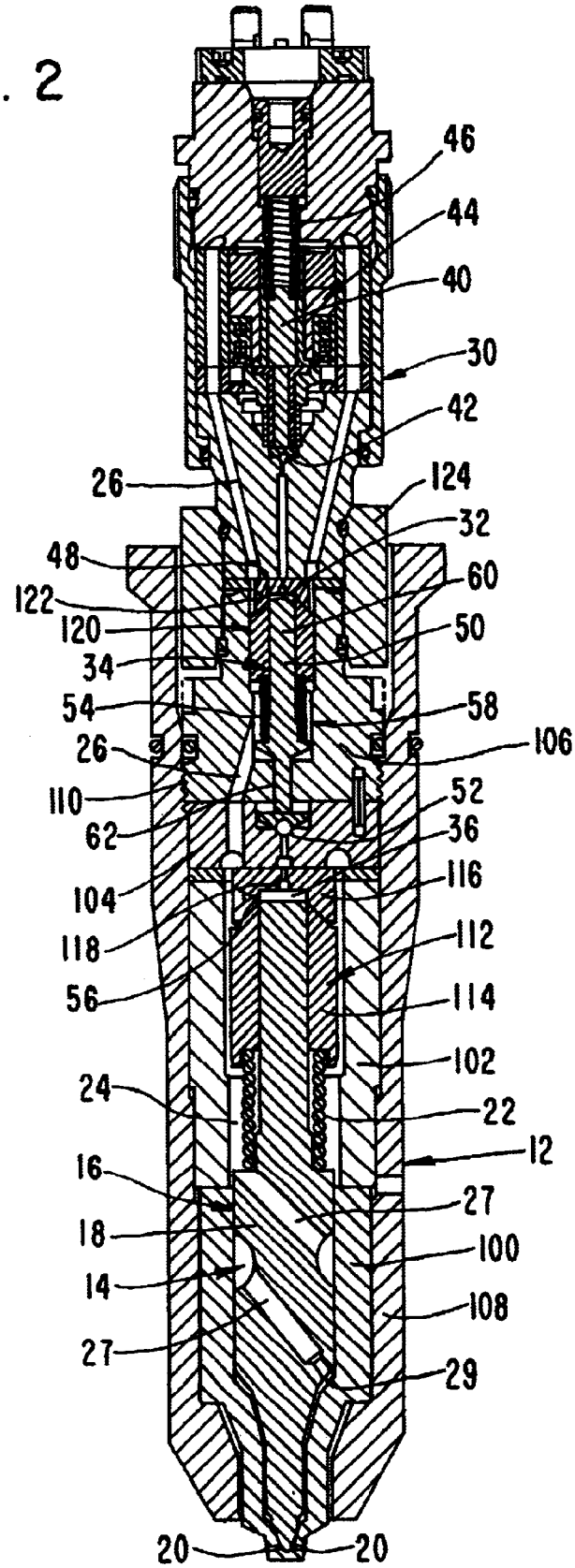
FIG. 2 is a detailed cross sectional view of a practical embodiment of the fuel injector of FIG. 1.

FIG. 2 discloses a cross sectional view of a practical embodiment of the same injector as FIG. 1 with like components referred to with the same reference numbers as used in FIG. 1. Injector body 12 specifically includes a lower nozzle housing 100, an upper nozzle housing 102, a spacer 104, a barrel 106 and a retainer 108. These components are held in compressive abutting relationship in the interior of retainer 108. For example, the outer end of retainer 108 may contain internal threads 110 for engaging corresponding external threads on barrel 106 to permit the entire injector body 12 to be held together by simple relative rotation of retainer 108 with respect to barrel 106. In this embodiment, nozzle valve element 18 may include two integral delivery passages 27 for directing flow past two guide portions of the nozzle valve element and into lower nozzle cavity 29. The outer portion of nozzle valve element 18 is positioned within a sealing sleeve 112 comprised of a lower sleeve portion 114 and an upper sleeve portion 116 which are held in sealed compressive abutting relationship by the bias force of spring 22. The inner control volume 36 is formed in upper sleeve portion 116 and drain circuit 38 includes an axial passage extending through upper sleeve 116 and spacer 104. High pressure fuel supply circuit 26 includes a supply port 118 formed in the side of upper sleeve 116. As can be seen from FIG. 2, inner injection control valve 34 is positioned in a bore formed in barrel 106. The outer portion of control valve member 50 extends into a two part sleeve, indicated generally at 120, in a similar manner to sleeve 112. Bias spring 54 abuts the inner end of sleeve 34 to maintain the two part sleeve in position. Likewise, a supply port 122 supplies fuel from high pressure fuel supply circuit 26 into outer control volume 32 formed in sleeve 34. Outer injection control valve 30 is mounted on fuel injector body 12 via a connector sleeve 124 which threadably engages the outer injection control valve body and barrel 106. As with the schematic illustration of FIG. 1, actuator assembly 44 may be a solenoid operated, two-way valve including control valve member 40 biased into the closed position by bias spring 46. The details of first injection control valve 30 are shown in FIG. 2; however, a similar injection control valve, disclosed in U.S. Pat. No. 6,056,264, the entire contents of which is hereby incorporated by reference, may be used.

The specific practical embodiment shown in FIG. 2 operates in substantially the same manner as the schematic showing of FIG. 1 as described hereinabove. Also, the advantages of the schematic showing of the present invention in FIG. 1 as described hereinabove equally apply to the specific embodiment of FIG. 2.

Figure 3A:
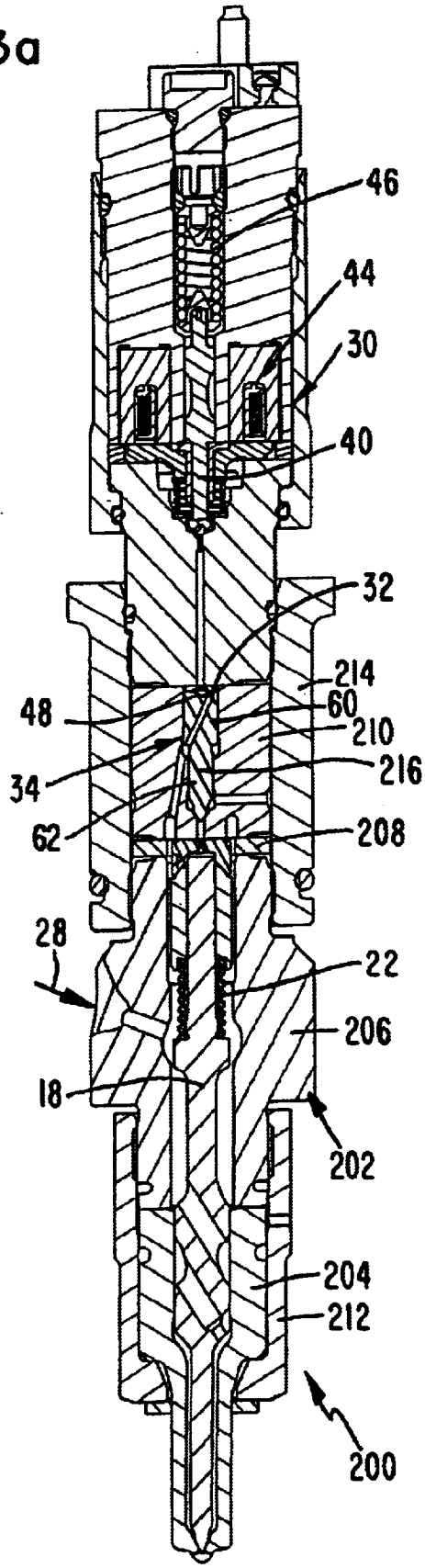
FIG. 3*a* is a detailed cross sectional view of a second practical embodiment of the fuel injector having a simplified inner control valve with fewer parts.
Figure 3B:
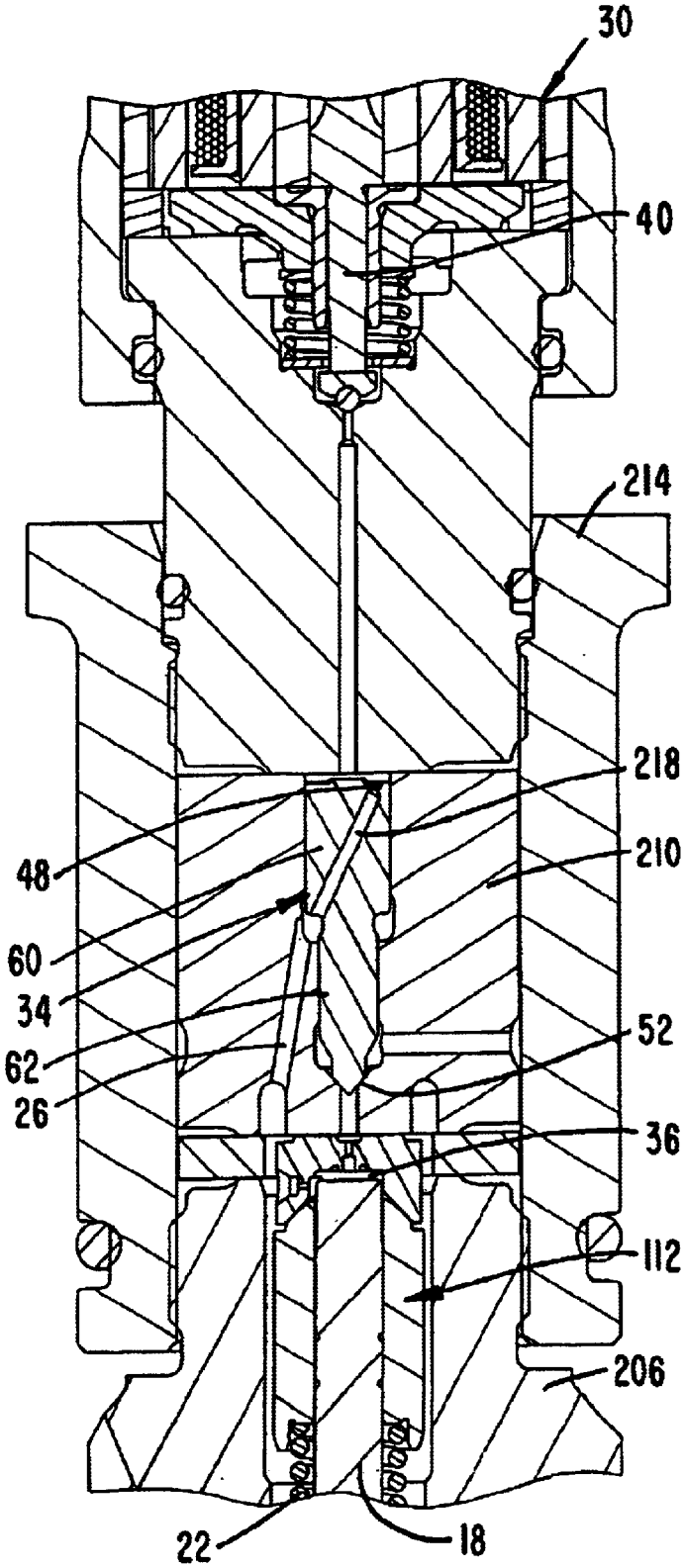
FIG. 3*b* is an expanded view of a portion of the injector of FIG. 3*a*.

FIGS. 3*a* and 3*b* disclose cross sectional views of a second practical embodiment of the same injector as FIG. 1 with like or similar components referred to with the same reference numbers as used in FIG. 1. Injector 200 of FIGS. 3*a* and 3*b* specifically includes an injector body 202 including a lower nozzle housing 204, an upper nozzle housing 206, a spacer 208, a barrel 210, a first retainer 212 and a second retainer 214. These components are held in compressive abutting relationship by retainers 212 and 214, the ends of which threadably engage threads formed on the outer surface of the injector body to permit the body to be held together by simple relative rotation of the retainers with respect to the other components. The injector of FIGS. 3*a* and 3*b* is of course also very similar to the injector of FIG. 2 with like components referred to with the same reference numbers as used in FIG. 2. The primary distinction between the present embodiment of FIGS. 3*a* and 3*b* and the previous embodiment of FIG. 2 is that the inner injection control valve 34 is a more simplified design including barrel 210 and single piece control valve member 216. It is noted that no bias spring is provided for inner injection control valve 34 since during normal operation the bias spring is not needed. During shutdown, the supply pressure provided to outer control volume 32 is sufficient to hold control valve member 216 in the closed position. If there is no pressure in the supply passage 26, for example during extended shutdown, leakage past inner injection control valve 34 to drain is acceptable. Upon startup, any pressure buildup in the fuel supply passage would immediately hold control valve member 216 closed. It should be noted that supply fuel is delivered to outer control volume 32 via high pressure supply circuit 26 which includes a transverse passage 218 (FIG. 3*b*) formed in control valve member 216. Also, the supply orifice 48 is located in the top end of passage 218 formed in control valve member 216. It should also be noted that although no bias spring is used in the preferred embodiment as shown, a bias spring may be included and positioned in outer control volume 32. The plunger stroke length of control valve member 216 of inner injection control valve 34 is set by grinding the member 216 to the predetermined length prior to assembly. The specific practical embodiment shown in FIGS. 3*a* and 3*b* operates in substantially the same manner as the schematic shown in FIG. 1 as described hereinabove. Also, the advantages of the schematic showing of the present invention in FIG. 1 as described hereinabove equally apply to the specific embodiment of FIGS. 3*a* and 3*b*.

Figure 4:
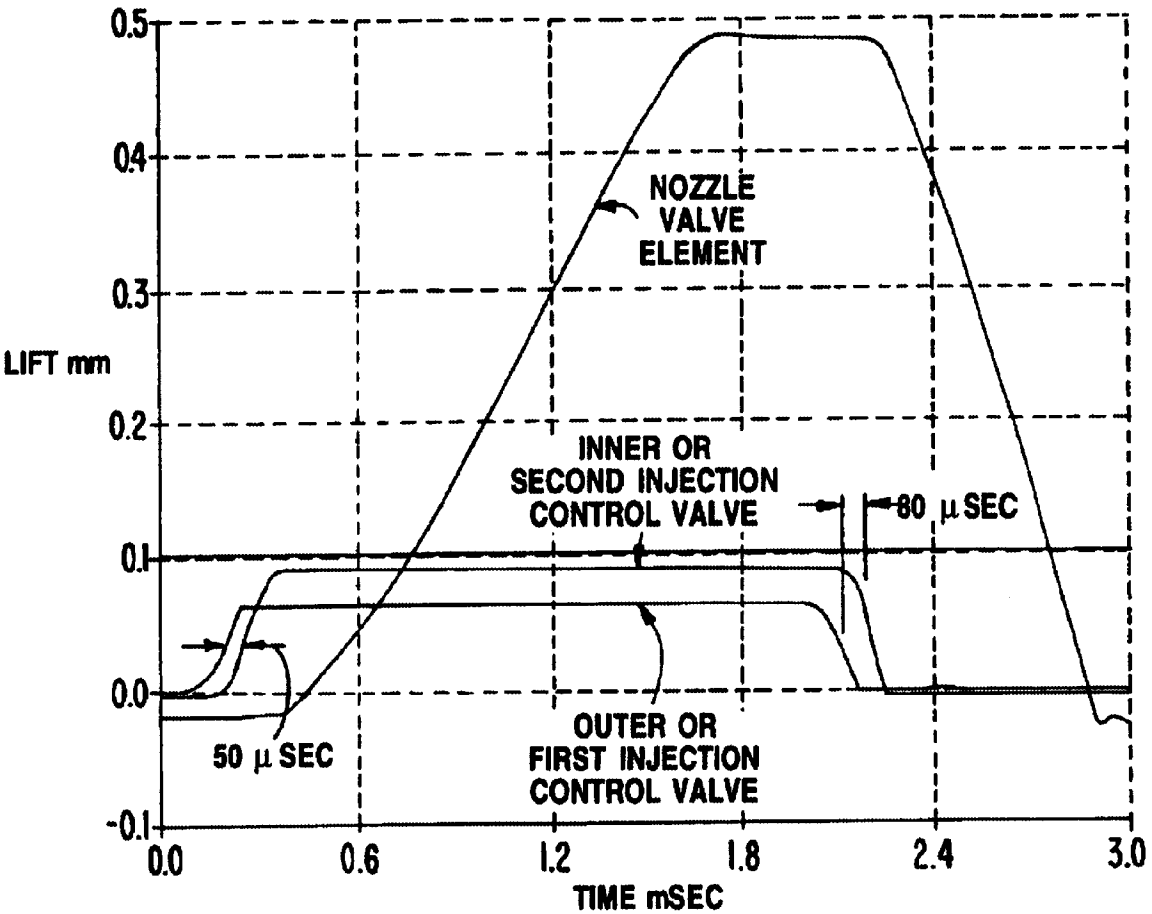
FIG. 4 a graph of nozzle valve element lift, first injection control valve lift, and second injection control valve lift versus time.

As illustrated in FIG. 4, the injection control valves and nozzle valve element open and close in sequence or series with the outer or first injection control valve 30 first opening followed by the opening of inner or second injection control valve 34 which then causes the opening of nozzle valve element 18. At the end of the injection event, outer injection control valve 30 is closed followed by the closing of inner injection control valve 34 which then causes nozzle valve element 18 to close. As the graph of FIG. 4 illustrates, a minimal delay of 50–80 microseconds exists between the operation of the inner and outer injection control valves 30, 34 respectively.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require accurate fuel injection control by a simple control device and, in particular, high horsepower diesel engines. Such internal combustion engines including a fuel injector in accordance with the present invention can be widely used in all industrial fields, commercial and noncommercial applications, including trucks, passenger cars, industrial equipment, stationary power plants and others.

We claim:

1. A fuel injector for injecting fuel at high pressure into the combustion chamber of an engine, comprising:

an injector body containing an injector cavity and an injector orifice communicating with one end of said injector cavity to discharge fuel into the combustion chamber;

a nozzle valve element positioned in one end of said injector cavity adjacent said injector orifice, said nozzle valve element movable between an open position in which fuel may flow through said injector orifice into the combustion chamber and a closed position in which fuel flow through said injector orifice is blocked;

a first control volume positioned to receive a pressurized supply of fuel;

a drain circuit for draining fuel from said first control volume to a low pressure drain;

a first valve seat positioned along said drain circuit;

a first injection control valve positioned along said drain circuit to control fuel flow from said first control volume, said first injection control valve including a reciprocally mounted control valve member movable between an open position permitting flow through said drain circuit and a closed position in sealing abutment against said first valve seat to block flow through said drain circuit;

a second control volume positioned adjacent an outer end of said nozzle valve element to receive a pressurized supply of fuel, said drain circuit positioned to drain fuel from said second control volume to the low pressure drain;

a second valve seat positioned along said drain circuit;

a second injection control valve positioned along said drain circuit to control fuel flow from said second control volume, said second injection control valve including a reciprocally mounted control valve member movable between an open position permitting flow through said drain circuit to cause a decrease in fuel pressure in said second control volume and movement of said nozzle valve element into said open position, and a closed position in sealing abutment against said second valve seat to block flow through said drain circuit to cause an increase in fuel pressure in said second control volume and movement of said nozzle valve element into said closed position, wherein movement of said first injection control valve into said open position causes a decrease in fuel pressure in said first control volume causing movement of said second injection control valve into said open position.

2. The injector of claim 1, wherein said first injection control valve includes a solenoid actuator assembly and said second injection control valve is spring biased into said closed position.

3. The injector of claim 1, further including a high pressure chamber positioned around said second injection control valve axially between said first injection control valve and said second control volume.

4. The injector of claim 3, wherein said second injection control valve includes a large diameter portion positioned axially between said first control volume and said high pressure chamber, and a small diameter portion having an outer diameter smaller than said large diameter portion and positioned axially between said high pressure chamber and said second control volume.

5. The injector of claim 3, wherein said second injection control valve includes a bias spring positioned in said high pressure chamber for biasing said second injection control valve into said closed position.

6. The injector of claim 1, wherein said nozzle valve element includes an outer diameter greater than a largest outer diameter of said second injection control valve member.

7. The injector of claim 1, wherein said nozzle valve element moves toward said second injection control valve into the open position.

8. The injector of claim 1, further including a bias spring for biasing said nozzle valve element into said closed position, a spring chamber containing said nozzle valve bias spring and a high pressure fuel supply circuit including at least a portion of said spring chamber.

9. The injector of claim 8, further including a high pressure chamber positioned around said second injection control valve axially between said first injection control valve and said second control volume, said high pressure fuel supply circuit including said high pressure chamber.

10. A fuel injector for injecting fuel at high pressure into the combustion chamber of an engine, comprising:

an injector body containing an injector cavity and an injector orifice communicating with one end of said injector cavity to discharge fuel into the combustion chamber;

a nozzle valve element positioned in one end of said injector cavity adjacent said injector orifice, said nozzle valve element movable between an open position in which fuel may flow through said injector orifice into the combustion chamber and a closed position in which fuel flow through said injector orifice is blocked;

an inner control volume positioned adjacent an outer end of said nozzle valve element to receive a pressurized supply of fuel;

an inner injection control valve means for draining pressurized fuel from said inner control volume to cause a decrease in fuel pressure in said inner control volume and movement of said nozzle valve element into said open position;

an outer control volume positioned adjacent an outer end of said inner injection control valve means to receive a pressurized supply of fuel; and an outer injection control valve means for draining fuel from said outer control volume to cause a decrease in fuel pressure in said outer control volume and movement of said inner injection control valve means into an open position.

11. The injector of claim 10, wherein said outer injection control valve means includes a solenoid actuator assembly and said inner injection control valve means is spring biased into an closed position.

12. The injector of claim 10, further including a high pressure chamber positioned around said inner injection control valve means axially between said outer injection control valve means and said inner control volume.

13. The injector of claim 12, wherein said inner injection control valve means includes a large diameter portion positioned axially between said outer control volume and said high pressure chamber, and a small diameter portion having an outer diameter smaller than said large diameter portion and positioned axially between said high pressure chamber and said inner control volume.

14. The injector of claim 12, wherein said inner injection control valve means includes a bias spring positioned in said high pressure chamber for biasing said inner injection control valve means into said closed position.

15. The injector of claim 10, wherein said nozzle valve element includes an outer diameter greater than a largest outer diameter of said inner injection control valve means.

16. The injector of claim 10, wherein said nozzle valve element moves toward said inner injection control valve means into the open position.

17. The injector of claim 10, further including a bias spring for biasing said nozzle valve element into said closed position, a spring chamber containing said nozzle valve bias spring and a high pressure fuel supply circuit including at least a portion of said spring chamber.

18. The injector of claim 17, further including a high pressure chamber positioned around said inner injection control valve means axially between said outer injection control valve means and said inner control volume, said high pressure fuel supply circuit including said high pressure chamber.

* * * * *